US008770509B2

(12) United States Patent
Tzur et al.

(10) Patent No.: US 8,770,509 B2
(45) Date of Patent: Jul. 8, 2014

(54) BOBBIN FOR ROLL STOCK

(75) Inventors: Gil Tzur, Ha'Emek (IL); Ran Cohen, Kibbutz Galed (IL)

(73) Assignee: Tama Plastic Industry (IL)

( * ) Notice: Subject to any disclaimer, the term of this patent is extended or adjusted under 35 U.S.C. 154(b) by 638 days.

(21) Appl. No.: 13/021,322

(22) Filed: Feb. 4, 2011

(65) Prior Publication Data

US 2012/0199684 A1 Aug. 9, 2012

(51) Int. Cl.
*B65H 75/08* (2006.01)

(52) U.S. Cl.
USPC ..... 242/613.5; 242/609.1; 242/611.1

(58) Field of Classification Search
USPC ..... 242/613.4, 613.5, 610.4, 611, 611.1, 242/609, 609.1, 609.4
See application file for complete search history.

(56) References Cited

U.S. PATENT DOCUMENTS

| | | | |
|---|---|---|---|
| 1,812,421 | A | 6/1931 | Wickware |
| 2,336,161 | A | 12/1943 | Blanchet |
| 3,471,102 | A | 10/1969 | Inouye et al. |
| 4,519,557 | A | 5/1985 | Newman |
| 4,720,057 | A | 1/1988 | Ono et al. |
| 5,271,258 | A | 12/1993 | Bernier et al. |
| 5,441,780 | A | 8/1995 | Bushell et al. |
| 5,820,049 | A | 10/1998 | Atkinson et al. |
| 6,045,087 | A | 4/2000 | Vislocky et al. |

FOREIGN PATENT DOCUMENTS

| | | | |
|---|---|---|---|
| DE | 20316500 | U1 | 3/2004 |
| FR | 2329568 | A1 | 5/1977 |
| GB | 539366 | A | 9/1941 |
| GB | 1263627 | A | 2/1972 |
| PL | 65692 | | 3/2010 |
| WO | 2005040022 | A1 | 5/2005 |

OTHER PUBLICATIONS

International Search Report and Written Opinion, PCT/IL2011/000284, dated Oct. 13, 2011.

*Primary Examiner* — Emmanuel M Marcelo
*Assistant Examiner* — Angela Caligiuri
(74) *Attorney, Agent, or Firm* — Lerner, David, Littenberg, Krumholz & Mentlik, LLP

(57) ABSTRACT

In one embodiment of the present invention, a device for supporting and storing wound material thereon may include a substantially cylindrical, hollow bobbin having a thickness defined by an inner and outer diameter for supporting and storing material wound around the exterior surface thereof, and a reinforcing apparatus located at one end of the bobbin, the apparatus having generally a cylindrical shape and a length comprising two zones, the outside surface of the first zone being in contact with a portion of an inner surface of the bobbin, and the second zone of the apparatus extending beyond the end of the bobbin.

24 Claims, 7 Drawing Sheets

BOBBIN FOR ROLL STOCK

BACKGROUND OF THE INVENTION

Many sheet-like materials are stored, transported, and supplied in the form of rolls, where the sheets are rolled up around a bobbin. These rolls are commonly known as "roll stock." Materials sold in rolls include fabrics, plastic films, paper products, aluminum foils, nets, yarn and wire products, and others.

Bobbins are generally cylindrical tubes and the most common types are made of cardboard of a great variety of thicknesses and strengths. To prepare roll stock, the bobbin is placed on a mandrel and the sheet material is wound onto it. Similarly, the roll stock may be placed onto a mandrel for dispensing the sheet material.

Cardboard, even in the form of rolls, is not a particularly strong material and can fail under circumstances in which it is bent, crushed and even cut into multiple pieces. As the rolled sheet material is wound more tightly around the bobbin, or where a heavier sheet-like material is used, the pressure on the bobbin increases, requiring a stronger bobbin to withstand the higher pressure. A common technique to increase the strength of a cardboard bobbin is to increase its wall thickness. In the case of wound material such as netting, not only is a bobbin subjected to greater pressure due to the heavy nature of the netting, but, by virtue of its make-up, netting applies a non-uniform concentrated pressure on certain points along the bobbin length. Cardboard bobbins are not sufficiently strong and resilient for supporting all sheet stock material. Moreover, when long rolls of material are stacked on top of one another, in transport or storage, the cardboard bobbins are subject to crushing. Therefore, the thickness of a cardboard bobbin is dependent on the particular type, length and width of the material to be rolled thereon, the circumstances of its use, as well as the length and diameter of the bobbin itself.

Cardboard bobbins are particularly vulnerable to water and humid conditions and as such must be protected from wet weather conditions as well as damp conditions present during storage, transport, and dispensing. Cardboard bobbins used in roll stock have limited reuse because of their susceptibility to damage from rain and humidity and from physical handling in transport, and because of the cost for protected storage space for bobbins between uses. Also, stronger cardboard bobbins, which may include additional cardboard layers for added protection from these damage issues, increase the expense of bobbins while not necessarily assuring reuse.

Other bobbins in common use are extruded PVC plastic tubes. These have some advantages over the cardboard bobbins in that they are largely weatherproof and can be manufactured by extrusion to infinite length and thereafter can be readily cut to different sizes as required. Their disadvantage is that they tend to crack when subjected to stress, particularly under low temperature conditions, and they are expensive to manufacture. Older plastic bobbins are also particularly brittle, especially if exposed to temperature extremes or sunlight.

Common cardboard bobbins presently in use comprise a series of paper layers, glued one layer to the next. If a particular area along the length of the bobbin must possess increased strength to support a greater weight of rolled material, the entire bobbin must be strengthened. This is because additional layers of cardboard needed to increase the strength of that particular area, must be added to the entire length of the bobbin, even if the area which requires the increased strength is only a small percentage of the overall length of the bobbin.

BRIEF SUMMARY OF THE INVENTION

One embodiment of the present invention includes a reinforcing apparatus which is associated with a bobbin to reinforce the bobbin and improve its strength and resistance to damage or failure. The reinforcing apparatus may be positioned on, in, around or adjacent to the end portion of the bobbin to protect the end of the bobbin and provide additional support and strength to the bobbin. The association between the reinforcing apparatus and the bobbin may be based on the friction between their surfaces or they may be attached in a temporary or permanent manner such as by a binding agent or by a physical engagement of their respective surfaces. It is preferred that the two elements operate as a solitary structure.

Another embodiment of the present invention includes a device for supporting and storing wound material thereon, which includes a substantially cylindrical, hollow bobbin having a thickness defined by an inner and outer diameter for supporting and storing material, such as sheet-like material, wound around the exterior surface thereof, and a reinforcing apparatus located at one end of the bobbin, said apparatus generally having a cylindrical shape and a length comprising two zones, the first zone in contact with a portion of the inner surface of the bobbin, and the second zone of the apparatus extending beyond the end of the bobbin, wherein the first zone has an outer diameter such that the first zone fits within the inner diameter of the bobbin and wherein the second zone has an outer diameter larger than the inner diameter of the bobbin, whereby the reinforcing apparatus provides strength and support to the bobbin. The bobbin and reinforcing apparatus may further be in a torque-transfer relationship such that, for example, a torque or turning force, applied to the reinforcing apparatus may be efficiently and evenly applied to the bobbin secured thereto. The device may further include a second reinforcing apparatus which is located at the other end of the bobbin. One of the benefits of using reinforcing apparatuses is that it enables the use of thinner bobbins saving on the costs and amount of cardboard, in contrast to conventional techniques requiring an increase in the thickness of the bobbin to achieve additional strength and resistance to failure. The first zone of the reinforcing apparatus may be maintained within the inner surface of the bobbin by the friction between their respective surfaces, by a binding agent present between their surfaces, or by a physical engagement of their respective surfaces, such as the presence of at least one ridge or raised area on the outer surface of the first zone to create a grip between the inner core surface of the bobbin and the reinforcing apparatus. Alternative techniques may be included on the outer surface of the first zone of the apparatus to fasten or append the apparatus to the bobbin.

The present invention may further include, in yet another embodiment, a method for imparting greater strength or resistance to damage or failure to a hollow, cylindrical bobbin, comprising adding to each end of the bobbin a reinforcing apparatus as discussed above.

In a further embodiment, the present invention includes a product for maintaining or storing a wound stock material, which includes a substantially cylindrical, hollow bobbin upon which roll stock material can be wound, maintained and unwound; a first reinforcing apparatus in connection with the bobbin located at an end of the bobbin and characterized by providing rigidity, strength and protection to the bobbin; and a roll stock material wound on the bobbin and the reinforcing apparatus. The embodiment may further include a second reinforcing apparatus at a second end of the bobbin.

In another embodiment, the present invention includes a device for supporting and storing wound material thereon, which includes a substantially cylindrical, hollow bobbin having an inner and outer diameter, whereby material is wound around the exterior surface of said bobbin, and a reinforcing apparatus located at one end of the bobbin, said apparatus having generally a cylindrical shape and a length, the reinforcing apparatus including a first cylindrical sleeve portion, which is in contact with the inner surface of the bobbin, wherein said first sleeve portion has an outer diameter less than or equal to the inner diameter of the bobbin, enabling the first sleeve portion to fit within a portion of the inner wall of the bobbin and whereby the reinforcing apparatus provides strength and support to the bobbin. The reinforcing apparatus may further include a second cylindrical portion extending beyond an end of the first sleeve portion wherein the outer diameter of the second portion is greater, than the inner diameter of the bobbin.

In an alternate embodiment, the present invention includes a device for supporting and storing wound material thereon, which includes a substantially cylindrical, hollow bobbin having an inner and outer diameter, which can support sheet-like material which is wound around the exterior surface of the bobbin, and a reinforcing apparatus located at least at one end of the bobbin, said apparatus having generally a cylindrical shape and a length, the reinforcing apparatus including the outer surface of a first cylindrical sleeve portion, whereby at least part of which is in contact with the inner surface of the bobbin, thereby having an outer diameter which is larger than, less than or equal to the inner diameter of the bobbin, and a second portion of which is characterized as having an outer diameter greater than the outer diameter of the sleeve portion of the apparatus. Therefore the reinforcing apparatus along its length has two different outer diameters. The two portions of the apparatus may have the same or different inside diameters. One or both portions may have a solid interior. Each portion may have substantially the same outer diameter or a constant outer diameter along its length.

In yet another embodiment, the present invention may include a device for supporting and storing wound material thereon, which may include a substantially cylindrical, hollow bobbin having an inner and outer diameter for supporting and storing material wound around the exterior surface thereof, and a reinforcing apparatus located at one end of the bobbin, said apparatus having generally a cylindrical shape and a length, the reinforcing apparatus comprising a first cylindrical sleeve portion, at least part of which is in contact with the inner surface of the bobbin, wherein the first portion has a first outer diameter such that the part of the first portion having the first outer diameter fits within the inner diameter of the bobbin, whereby the reinforcing apparatus provides strength and support to the bobbin. The reinforcing apparatus may further include a flanged end. The flanged end may further abut an end surface of the bobbin. The reinforcing apparatus may further include a second cylindrical end portion, at least a part of which is positioned over the first sleeve portion, wherein the second portion has an outer diameter larger than the inner diameter of the bobbin. The first and second portions may secure to one another by a male-female connection, or the like, between the flanged end of the first portion and an end structure of the second portion.

DETAILED DESCRIPTION

Figure 1:
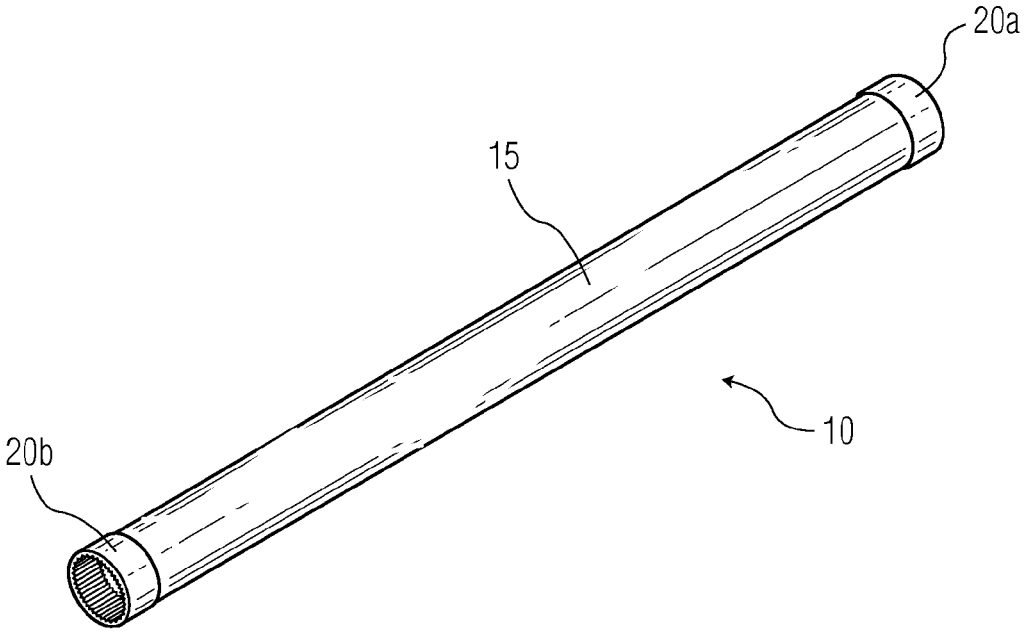
FIG. 1 illustrates a first embodiment of the present invention.
Figure 10A:
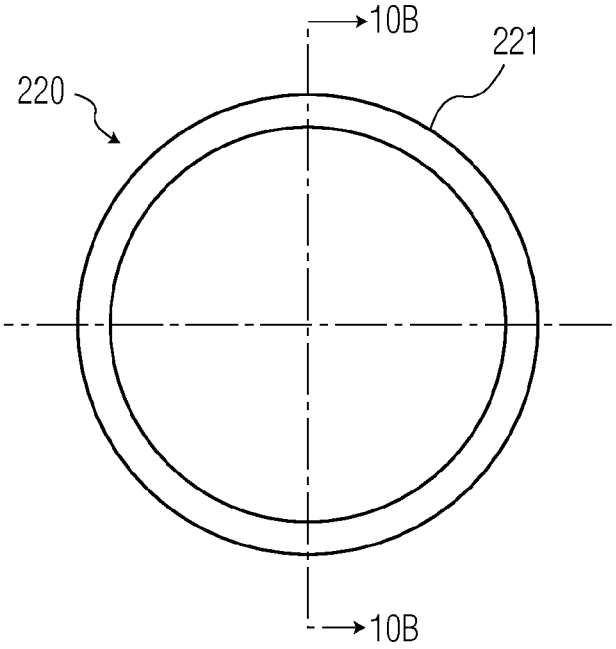
FIGS. 10*a* and 10*b* illustrate a further embodiment of the reinforcing apparatus of the present invention.

As illustrated in FIG. 1, in a first embodiment, a first reinforcing apparatus 20*a* may be positioned on an end of a bobbin 15 to form a roll stock core 10. As illustrated, both the bobbin 15 and reinforcing apparatus 20*a* are generally cylindrical and hollow, each having at least one inner diameter and outer diameter. The reinforcing apparatus 20*a* may be affixed to the inner surface of bobbin 15, such that it may be removed, e.g., a press-fit maintained by friction between the surfaces, or may be fixedly secured, e.g., by use of an adhesive. A second reinforcing apparatus 20*b* may also be included, as shown at the opposite end of the bobbin 15. As illustrated in FIG. 10, the roll stock core 10 may be used to organize, store and transport a material 60 rolled thereon to form a product 50.

Figure 2:
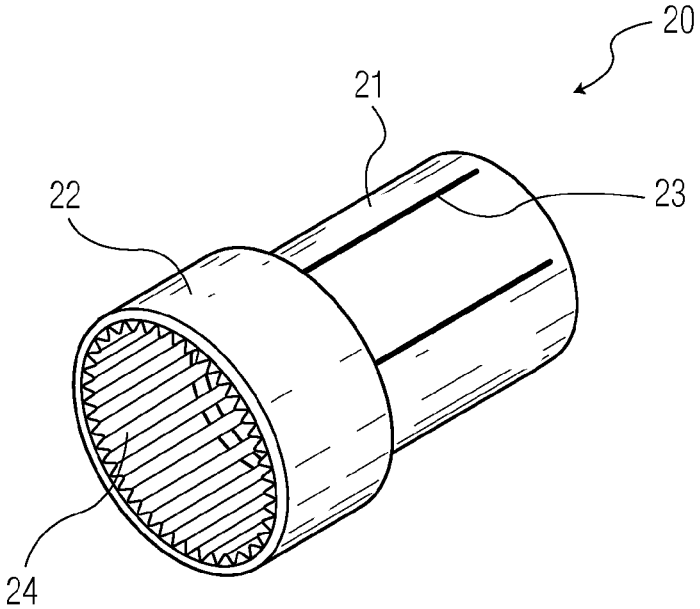
FIG. 2 illustrates one embodiment of the reinforcing apparatus of the present invention.

In one embodiment, as illustrated in FIG. 2, a reinforcing apparatus 20 may include a first zone 21 and a second zone 22. Zones 21 and 22 may be elements of the same monolithic structure, or may be separate pieces connected together to operate as a single structure. Alternatively, first zone 21 may be used individually, without zone 22. First zone 21 may have a substantially cylindrical shape, a length and a diameter such that at least a portion of first zone 21 fits within and contacts the inner surface of a bobbin.

Second zone 22 has a substantially cylindrical shape and is characterized as having an outer diameter greater than the outer diameter of the first zone 21. First zone 21 may have an outer diameter sized to fit within the inner diameter of the bobbin 15. For example, the outer diameter of the first zone 21 may be the same size as the inner diameter of the bobbin 15, may be less than the size of the inner diameter of the bobbin 15, slightly larger than the inner diameter of the bobbin 15, or the like, such that the bobbin and first zone achieve a secure connection. As to the configuration of the outer diameter of the first zone being larger than the inner diameter of the bobbin, the two may be combined through a press-fit such that the inner diameter of the bobbin slightly expands under the force to accommodate the outer diameter of the first zone 21. When reinforcing apparatus 20 is installed on a bobbin, as shown FIG. 1, the second zone 22 extends beyond the end of bobbin 15. Zone 22 may be secured to the end of zone 21, may slide over at least a portion of zone 21, or may be, if monolithic, manufactured as a single piece extending from zone 21. Zone 22 may also be generally cylindrical, though it is anticipated that zone 22 may be of any desired shape. Zone 21 may also be a shape other than generally cylindrical, so long as it can operatively contact the inner surface of the bobbin, to perform as discussed herein. Regardless of the desired configuration of first and second zones, the inner diameter of the first zone can be the same as or different from the inside diameter of the second zone.

First zone 21 may further include one ridge 23 or a multiple of ridges 23 along at least a portion of its length. The at least one ridges—that would make contact with the inner surface of bobbin 15 when the first zone 21 is placed within bobbin 15. Such contact may create a stronger connection between the reinforcing apparatus 20 and bobbin 15 which may result in a more efficient torque-transfer relationship upon use of the material on the bobbin. For example, when the roll stock core 10, with material 60 thereon, is placed on a mandrel (not shown), or other piece of machinery, the torque of the mandrel may be applied largely to the reinforcing apparatus, but not necessarily the bobbin 15, or at least to a lesser degree to the bobbin 15 than the reinforcing apparatus 20. The at least one ridge 23 may assist in transferring the torque, applied to the reinforcing apparatus, to the bobbin 15 by providing a stronger connection between the reinforcing apparatus and the bobbin. The ridge 23 may, for example, impart greater friction between the reinforcing apparatus and the bobbin to minimize any rotation of the reinforcing apparatus relative to the bobbin. Instead, the at least one ridge may force the two components to rotate together when the rotational force is applied solely to or generally to the reinforcing apparatus. Such a transfer helps maintain a consistent turning motion of the entire roll stock core 10 to allow for even distribution of material from the roll stock core 10.

Figure 3:
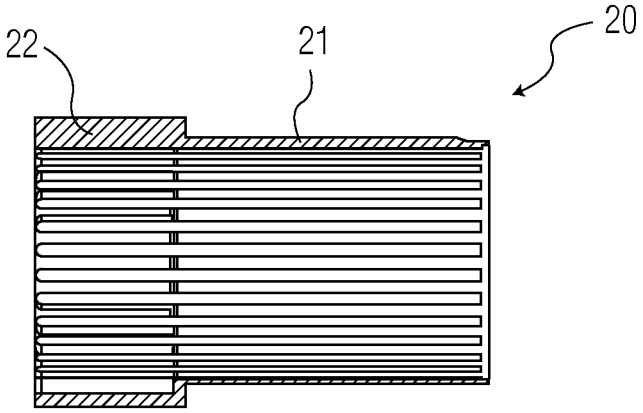
FIG. 3 illustrates a cross-sectional view, from FIG. 4, of the reinforcing apparatus of FIG. 2.
Figure 4:
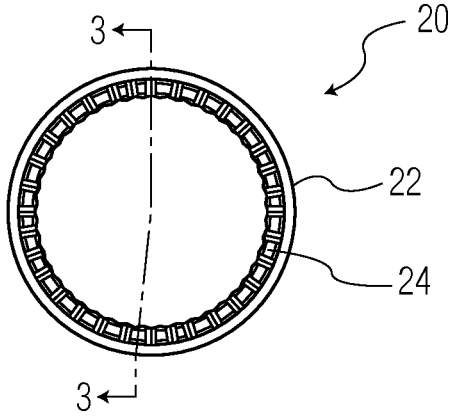
FIG. 4 illustrates an end elevation view of the reinforcing apparatus of FIG. 2.
Figure 5:
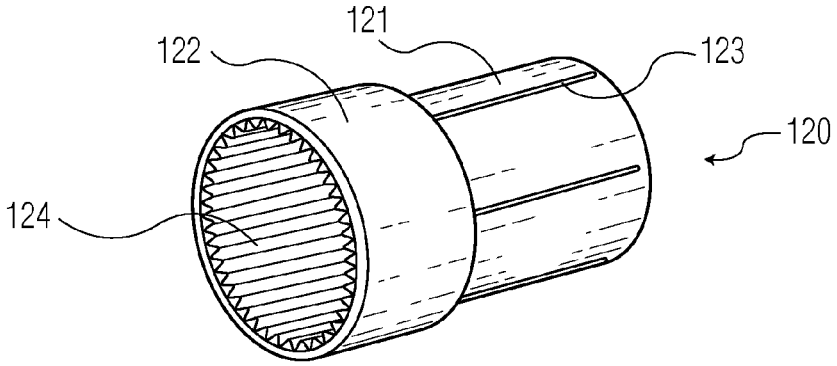
FIG. 5 illustrates a further embodiment of the reinforcing apparatus of the present invention.
Figure 6:
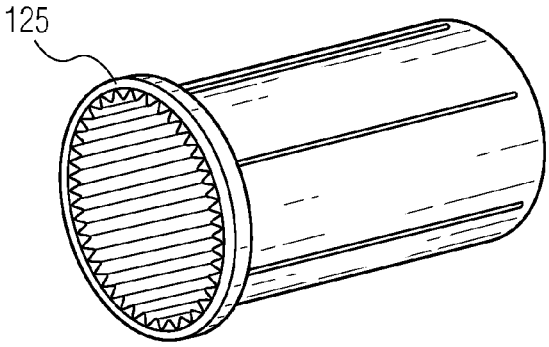
FIG. 6 illustrates one portion of the reinforcing apparatus of FIG. 5.
Figure 7:
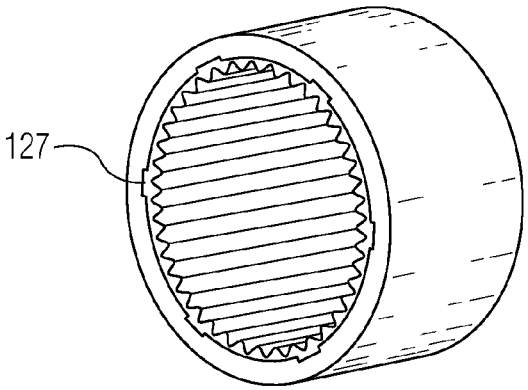
FIG. 7 illustrates another portion of the reinforcing apparatus of FIG. 5.

As illustrated in FIGS. 2-4, the second zone 22 may further include a plurality of slots or grooves 24 extending along at least a portion of the inner surface of second zone 22 in a substantially longitudinal direction. Of course, the slots or grooves 24 may be in a spiral configuration, may be circumferential, or the like. Slots or grooves 24 may extend through at least a portion of the inner surface of first zone 21 as well. Slots or grooves 24 may assist the reinforcing apparatus 20 in gripping a mandrel (not shown), for example, a metal shaft positioned through the hollow bobbin, when the material is being wound or unwound on the bobbin 15 for more efficient transfer of torque from the mandrel to the reinforcing apparatus 20. These slots or grooves 24 may further control the tension of the wound material once the material is in use. For example, if the wound material is a netting for baling hay, cotton, or other agricultural material, the slots or grooves of the reinforcing apparatus may provide tension on the unwound portion of the netting, during the baling process, such that the netting is wrapped tightly around the agricultural material.

In one possible alternative arrangement, the bobbin and reinforcing apparatus may have a bore hole, generally perpendicular to a longitudinal axis of the bobbin, through which a pin or the like may be placed to provide further securement between the two components. This may also assist in greater torque transfer from the mandrel, through the reinforcing apparatus, and to the bobbin.

The first zone 21 of the reinforcing apparatus may extend into a predetermined portion of the length of the bobbin. The length of the first zone may depend on, for example, the structure of the bobbin to be used, the type of material to be stored on the bobbin, the intended use of the bobbin, and the like. Thus, by example, if the bobbin to be used is very thin, but the material to be stored on the bobbin is heavy, then the first zone may extend along a majority of the length of the bobbin. Alternatively, if the material is light (or the bobbin has a thicker structure), then the first zone may only extend into the bobbin a sufficient depth to secure the reinforcing apparatus to the bobbin. Any desired configuration may be used within the scope of this invention.

This benefit of the reinforcing apparatus first zone 21, when used with a typical cardboard bobbin, or the like, may also reduce costs associated with the cardboard bobbin. For example, the reinforcing apparatus can strengthen a portion of the bobbin without requiring the entire bobbin to be strengthened along its entire length, as was done previously, by designing the first zone 21 to extend only part-way along the length of the bobbin. Thus, costs associated with having to strengthen the entire length of the bobbin, through additional paper layers or the like, are negated.

In another embodiment, a device for supporting and storing wound material thereon may include a bobbin having an inner and outer diameter and a reinforcing apparatus 120, the reinforcing apparatus may include a first cylindrical sleeve portion 121, at least part of which may be in contact with the inner surface of the bobbin. The first portion 121 may have a first outer diameter such that the part of the first portion having the first outer diameter may fit within the inner diameter of the bobbin, such that the reinforcing apparatus 120 may impart strength and support to at least a portion of the bobbin. The first portion 121 may include a length and a width. Further, first sleeve portion 121 may include a flange surface 125.

Figure 8:
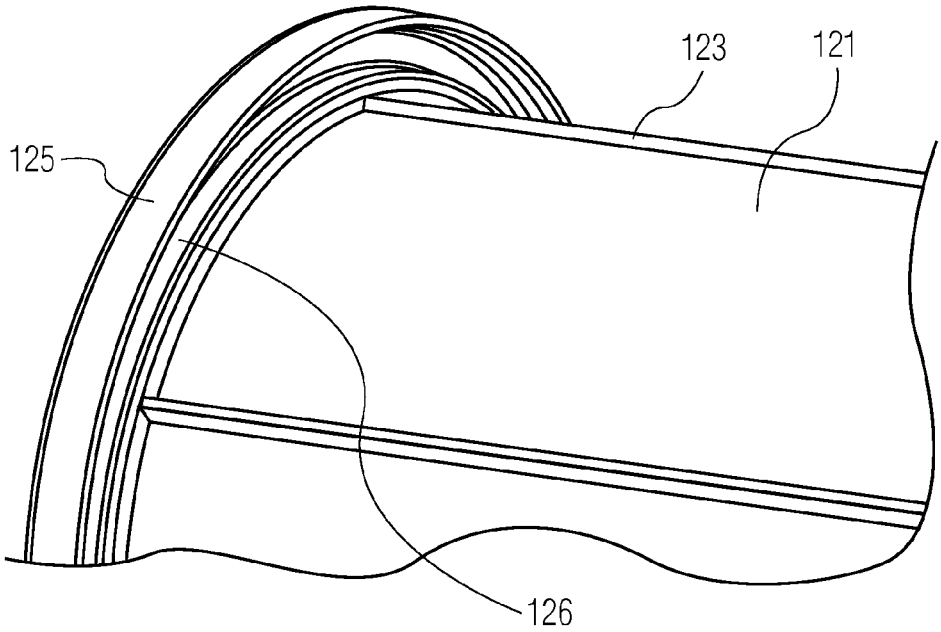
FIG. 8 illustrates one embodiment of the reinforcing apparatus of the present invention.
Figure 9A:
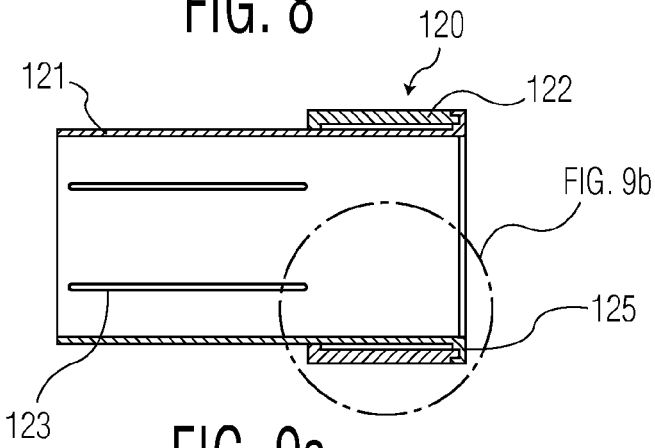
FIGS. 9*a* and 9*b* illustrate cross-sectional details of the reinforcing apparatus of FIG. 8.
Figure 9B:
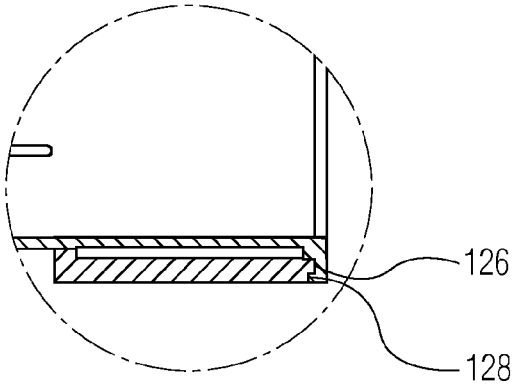

The first portion 121 may be used independently with the bobbin. Alternatively, the reinforcing apparatus may include a second cylindrical end portion 122, at least a part of which may be positioned over the first sleeve portion 121. The second portion 122 may have a diameter larger than the inner diameter of the bobbin. Flange surface 125 of first sleeve portion 121 interacts with the second end portion 122 such that they may be secured together to inhibit movement between the first and second portions. This connection may be a male-female connection 126, 128, as illustrated in FIGS. 8, 9*a* and 9*b*. Of course, other connections may be used such as a different variation of a press-fit, a thread, a locking element such as a bolt of screw, or the like.

The first portion 121 may further include one or more ridges 123 that parallel its length which are raised above the outer surface. While the ridge 123 may perform similar functions as discussed above, in this embodiment, the at least one ridge 123 may include a further function of mating with at least one groove 127 on the second end portion 122. Such mating engagement may provide an additional connection between the first and second portions of the reinforcing apparatus which may further limit motion between the first and second portions. The first portion 121 may further include a plurality of slots or grooves 124 which may be positioned on at least a portion of the inner surface of the first portion 121, and may perform a similar function as discussed above. Of course, since the second end portion 122 is positioned over the first portion 121, the slots or grooves 124 need not be present on the second end portion.

Alternatively, in another embodiment, the reinforcing apparatus may include, along its length, a first part of the length having the first outer diameter (such as reference 121), and a second part of the length having a second outer diameter (such as reference 122). The first diameter on the sleeve or first zone portion 121 may be less than the second diameter. Such a variation may be an example of the reinforcing apparatus as a monolithic structure, and may look similar to the two-part structure illustrated in FIG. 8. The inner surface of the monolithic reinforcing apparatus may include slots or grooves along at least a portion of the length thereof, and may include an at least one ridge on the outer surface of the first portion.

Figure 10B:
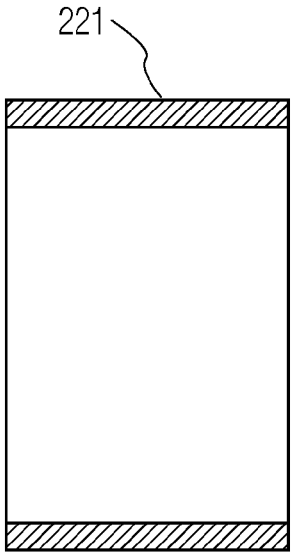
Figure 11A:
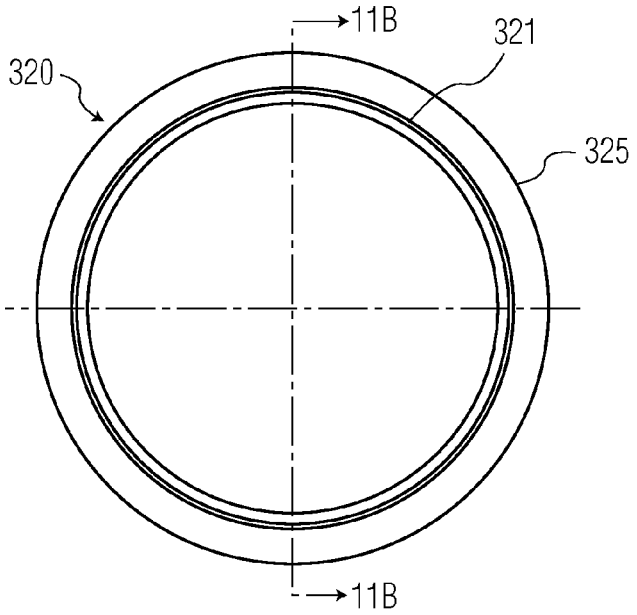
FIGS. 11*a* and 11*b* illustrate a further embodiment of the reinforcing apparatus of the present invention.
Figure 11B:
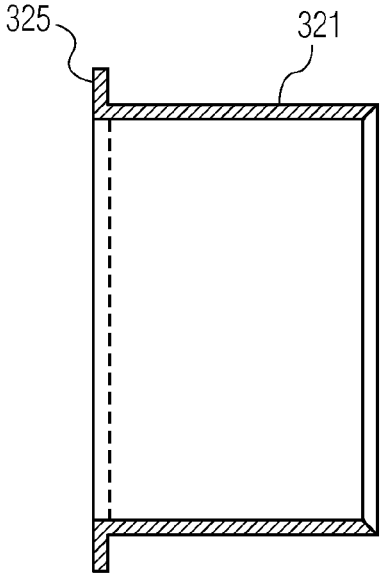

FIGS. 10*a*, 10*b*, 11*a* and 11*b* all illustrate alternative embodiments where the reinforcing apparatus 220, 320 may include only a first zone or portion 221, 321. FIGS. 10*b* and 11*b* are cross-sections of FIGS. 10*a* and 11*a*, respectively. As in FIGS. 10*a* and 10*b*, the first portion 221 may include a substantially consistent diameter throughout its length and may further be designed to be positioned completely within, or substantially within, a bobbin. Reinforcing apparatus 220 may be positioned anywhere along the length of the bobbin, such as at an end of the bobbin or within a middle portion of the bobbin. As other embodiments, the length of reinforcing apparatus 220 may be any length desired. Further, the reinforcing apparatus 220 may include grooves or slots or ridges as disclosed above.

FIGS. 11*a* and 11*b* illustrate a reinforcing apparatus 320 including a first portion 321 which includes a flange surface 325 which may abut the end surface of a bobbin. The flange may have a diameter which is larger than the diameter of the rest of the first portion 321, and which may also be larger than the inner diameter of the bobbin. In this embodiment, the flange may provide an additional securement for the reinforcing apparatus to the bobbin. Additionally, the flange may protect the end surfaces of the bobbin from damage. Further, the reinforcing apparatus 320 may include grooves or slots or ridges as disclosed above.

Figure 12:
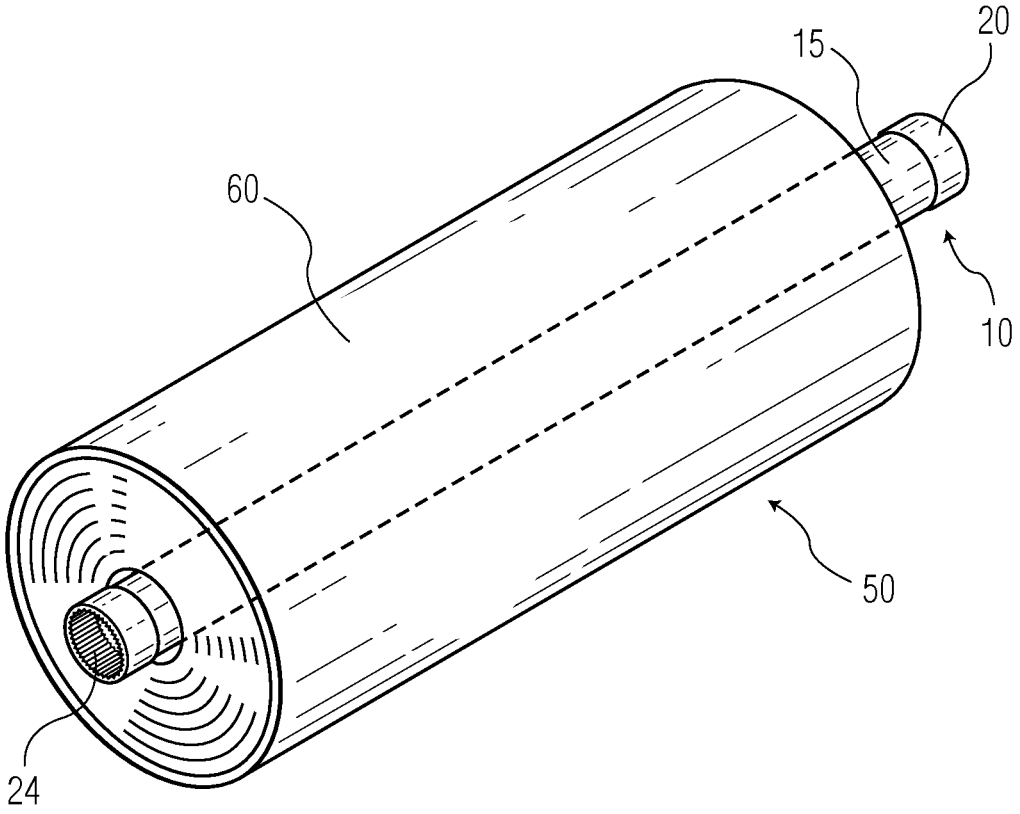
FIG. 12 illustrates one embodiment of a product of the present invention.

The decision as to whether a reinforcing apparatus includes a second portion 22, 122 or only a first portion (as 221, 321) is based on numerous factors. For example, the second portion 22, 122 may be used as an extension of the bobbin, such that the wound material may also be wound on the second portion 22, thus a shorter bobbin may be required to hold a wound material. Thus, for example, using the illustration of FIG. 12, in this arrangement the material would extend onto the exposed second portion of the reinforcing apparatus rather than being wound just on the bobbin (as FIG. 12 illustrates).

Additionally, if the particular wound material includes additional material on the end portions, such that additional material is at one or both ends of the wound material, the second portion 22, 122 may impart the additional strength needed to support this additional material. Alternatively, if, for example, the bobbin is to be used in a baler, e.g., to dispense wrapping material stored thereon to wrap agricultural products, the reinforcing apparatus can be used with or without the second portions 22, 122, according to the type of material and the type and dimensions of the baler.

The dimensions of the reinforcing apparatus 20, 120, 220, 320 may be any size appropriate to provide the necessary strength of the bobbin, based on the strength of the bobbin itself, the weight of the wound material on the bobbin, the number of loaded bobbins that may be stacked upon one another, and other considerations. In one example, the first zone, or first sleeve portion may have a length between about 20 mm and about 250 mm, and outer diameter between about 40 mm and about 140 mm, and an inner diameter between about 35 mm and about 135 mm. The second zone, or second end portion, may have a length between about 5 mm and about 100 mm, and outer diameter between about 50 mm and about 150 mm, and an inner diameter between about 40 mm and about 140 mm.

The reinforcing apparatus may be of any advantageous length, diameter or width, sufficient to provide the desired strength and support to the bobbin. The apparatus may be used on any length or diameter bobbin. For example, if the bobbin is of an extremely long length, and the material wrapped thereon is heavy, the length of the reinforcing apparatus may be longer to assist the long bobbin in supporting the heavy material wrapped thereon. Conversely, if the bobbin is fairly short, and carries a light material thereon, the reinforcing apparatus may be shorter in order to provide a smaller amount of additional support, and also to provide protection from weather and the like. Of course, in the example of the light material on a bobbin, the reinforcing apparatus may still have a longer length if it is desired, for example, to allow the cardboard bobbin to be thinner, thereby reducing the amount of cardboard required.

The reinforcing apparatus may be made from plastic, thermoplastic, metal, cardboard, a flexible resinous material or the like, and may be used with a bobbin of any material such as cardboard, PVC, other plastic or the like, and may further be degradable or reusable. The reinforcing apparatus should be of a material that is water resistant, or include a coating or film that is water resistant. Regardless of the material used, the reinforcing apparatus should add as little weight as possible to the bobbin structure, to minimize negative affects of heavy bobbins on the machines operating with the bobbin during transport, storage, usage and the like. The reinforcing apparatus may be manufactured through injection molding, pressing, binding or adhering processes, or the like as is known in the art.

The reinforcing apparatus is intended to provide protection to the cardboard bobbin, such that, when positioned on the end of the bobbin, the reinforcing apparatus may protect the ends of the cardboard bobbin against moisture, collapse, or damage from a machine such as a mandrel, baler, or the like. For example, the reinforcing apparatus may protect the bobbin from rain or humidity, and additionally, if the bobbin does sustain water damage, the reinforcing apparatus may prevent a damaged bobbin from buckling or crushing. Generally, for example, the reinforced apparatus and bobbin 15, forming the roll stock core 10, may have sufficient dimensions and strength to wind and maintain thereon the wound material having a weight per square foot in the range of about 0 to about 50 bar per square foot. The wound material may be, for example, netting, fabric, carpeting, plastic film, paper products, composite wrapping material or the like, and can be used in covering or wrapping goods or surfaces. For example, such goods may be agricultural goods such as cotton, hay or straw, though any other types of goods are also suitable for wrapping with such wound material.

Alternatively, the reinforcing apparatus may be positioned on or in the bobbin to protect and provide support to only specific portions of the bobbin. For example, if the bobbin is used to store material which includes extra material on only one side of the length of the material, the reinforcing apparatus may be placed specifically at the point on the bobbin where the extra material will be positioned on the bobbin. Similarly, if the added material is located in the center of the length of material, then the reinforcing apparatus would be located in the center of the bobbin to reinforce that portion of the bobbin which may undergo additional pressure from the added material. Such asymmetrical material is illustrated by decorative fabrics or carpeting having an additional layer of material in limited areas. As referenced above, the reinforcing apparatus allows for a thinner overall bobbin to be used in such an instance than was used previously. Prior to use of the reinforcing apparatus, the bobbin would have had to include additional layers of paper along the entire length of the bobbin in order to support the additional material located only on a portion of the length of the bobbin. The use of the reinforcing apparatus may limit or negate the need for such application of additional layers.

In another embodiment, illustrated in FIG. 12, the present invention may include a product 50 for maintaining or storing a wound stock material thereon, the product 50 may include a cylindrical, hollow bobbin 15 for winding and maintaining roll stock material thereon, a first reinforcing apparatus 20, 120 in connection with the bobbin which may be located at an end of the bobbin and characterized by adding rigidity, strength and protection to the bobbin, and a roll stock material 60 wound onto the bobbin. The product may further include a second reinforcing apparatus which may be positioned at the other end of the bobbin 15. As above, the roll stock material 60 may include, for example, netting fabric, carpeting, plastic film, paper products, composite wrapping material or the like. While the examples of the present invention have applied to agricultural uses, it is envisioned that such a product may be used for other industrial and commercial uses as well.

In a further embodiment, the present invention may include a method for imparting greater strength to a hollow, cylindrical bobbin, the method may include adding to each end of the bobbin a reinforcing apparatus 20, 120 as discussed above. Particularly when a cardboard bobbin, or the like, is used, the reinforcing apparatus 20, 120 of the present invention may serve to protect the bobbin from the weather, moisture, crushing pressure, or the like, such that the roll stock core 10 may have greater strength and resistance to breakage.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

The invention claimed is:

1. A device for supporting and storing wound material thereon, comprising:

a substantially cylindrical, hollow bobbin having a thickness defined by an inner and outer diameter for supporting and storing the material wound around an exterior surface of the bobbin, and a reinforcing apparatus located at one end of the bobbin, said apparatus having generally a cylindrical shape and a length comprising first and second zones, an outer surface of the first zone being in contact with a portion of an inner surface of the bobbin, and the second zone of the apparatus positioned entirely beyond an end of the bobbin, the first and second zones secured to one another through a releasable connection, wherein the first zone has an outer diameter such that the first zone fits within the inner surface of the bobbin and wherein the second zone has an outer diameter larger than the inner diameter of the bobbin, whereby the reinforcing apparatus provides strength and support to the bobbin.

2. The device of claim 1, wherein the bobbin and reinforcing apparatus are in a torque-transfer relationship.

3. The device of claim 1, further comprising a second reinforcing apparatus located at a second end of the bobbin.

4. The device of claim 1, wherein the reinforcing apparatus is one of fixedly secured or removably connected to the bobbin.

5. The device of claim 4, wherein the reinforcing apparatus is maintained by the friction between contact surfaces of the bobbin and the reinforcing apparatus.

6. The device of claim 1, wherein the outer surface of the first zone of the reinforcing apparatus comprises at least one ridge to create a grip between the inner surface of the bobbin and the reinforcing apparatus.

7. The device of claim 1, wherein the reinforcing apparatus has an open inner space that communicates with a hollow interior of the bobbin and an inner surface of at least one of the first and second zones of the reinforcing apparatus comprises longitudinal slots or grooves.

8. The device of claim 1, wherein the bobbin comprises a degradable material or a reusable material.

9. The device of claim 1, wherein the reinforcing apparatus is water resistant and comprises a different material from that of the bobbin.

10. The device of claim 1 wherein an inner diameter of the reinforcing apparatus is substantially the same throughout its length.

11. The device of claim 1, wherein the wound material applies to the reinforcing apparatus and bobbin a pressure per square foot in the range of about 0 to about 50 bar per square foot.

12. The device of claim 11, wherein the wound material is selected from the group consisting of netting, fabric, plastic film, composite wrapping material, carpeting and a paper product.

13. The device of claim 11, wherein the wound material comprises wrapping material for bales of cotton, hay or straw.

14. The device of claim 1, wherein the first zone includes a length between about 20 mm and about 250 mm, an inner diameter between about 35 mm and about 135 mm, and the outer diameter between about 40 mm and about 140 mm, and the second zone of said reinforcement apparatus has a length between about 5 mm and about 100 mm, an inner diameter between about 40 mm and about 140 mm, and the outer diameter between about 50 mm and about 150 mm.

15. The device of claim 1, wherein the releasable connection is a male-female connection.

16. A product for maintaining or storing a wound stock material, comprising:

a substantially cylindrical, hollow cardboard bobbin for winding and maintaining the wound stock material thereon; and a first reinforcing apparatus in connection with the bobbin located at an end of the bobbin and characterized by adding rigidity, strength and protection to the bobbin, the first reinforcing apparatus including a first zone, a portion of which is positioned within the bobbin, and a second separate zone, positioned on another portion of the first zone, the first and second zones secured to one another through a releasable connection, wherein the wound stock material is wound on the bobbin and reinforcing apparatus.

17. The product of claim 16, further comprising a second reinforcing apparatus at a second end of the bobbin.

18. The product of claim 16, wherein the wound stock material comprises netting, fabric, plastic film, composite wrapping material or paper products.

19. The product of claim 16, wherein the wound material is for agricultural uses.

20. The device of claim 16, wherein the releasable connection is a male-female connection.

21. A device for supporting and storing wound material thereon, comprising:

a substantially cylindrical, hollow bobbin having an inner and outer diameter for supporting and storing the wound material around an exterior surface of the bobbin, and a reinforcing apparatus located at one end of the bobbin, said apparatus having generally a cylindrical shape and a length, the reinforcing apparatus comprising a first cylindrical sleeve portion having a flanged end, at least part of which is in contact with an inner surface of the bobbin, and a second, separate cylindrical end portion, at least a part of which is positioned over the first sleeve portion, the first and second portions secured to one another through a releasable connection, wherein the second end portion has an outer diameter larger than the inner diameter of the bobbin, wherein at least a part of the first sleeve portion has a first outer diameter such that the part of the first portion having the first outer diameter fits within the inner diameter of the bobbin, whereby the reinforcing apparatus provides strength and support to the bobbin.

22. The device of claim 21, wherein the flanged end of the first sleeve portion and the second cylindrical end portion are secured together to inhibit movement between the first and second portions.

23. The device of claim 22, wherein the first sleeve portion and second end portion are secured together by a male-female press-fit, wherein one aspect of the male-female press-fit is the flanged end of the cylindrical sleeve portion adapted to receive a portion of the second cylindrical end portion therein.

24. The device of claim 21, wherein the releasable connection is a male-female connection.

* * * * *